United States Patent [19]

Niedermeyer

[11] 3,999,890

[45] Dec. 28, 1976

[54] ENCLOSED SUMP PUMP

[76] Inventor: Karl O. Niedermeyer, 17W068 North St., Bensenville, Ill. 60106

[22] Filed: Dec. 19, 1974

[21] Appl. No.: 534,468

Related U.S. Application Data

[63] Continuation-in-part of Ser. No. 460,423, April 12, 1974, Pat. No. 3,941,507.

[52] U.S. Cl. ..... 417/17; 417/36; 417/38; 417/40; 417/361; 417/421

[51] Int. Cl.[2] ..... F04B 49/00; F04B 49/04

[58] Field of Search ..... 417/17, 25, 36, 38, 417/40, 360, 361, 424, 421

[56] References Cited

UNITED STATES PATENTS

| | | | |
|---|---|---|---|
| 1,747,357 | 2/1930 | Frenier | 417/17 |
| 2,272,585 | 2/1942 | Rocke | 417/424 |
| 2,918,016 | 12/1959 | Olson | 417/421 |
| 2,930,867 | 3/1960 | Nash | 417/40 |
| 3,070,021 | 12/1962 | Tutthill | 417/38 |
| 3,272,136 | 9/1966 | Franzen | 417/424 |
| 3,656,866 | 4/1972 | Hine et al. | 417/38 |

*Primary Examiner*—William L. Freeh
*Assistant Examiner*—G. P. LaPointe
*Attorney, Agent, or Firm*—Darbo, Robertson & Vandenburgh

[57] ABSTRACT

All of the components of a sump pump apparatus necessary to be in the sump are enclosed in a common case. In one embodiment, this case is of plastic and holds the motor means, the pump impeller and at least part of the water level sensors. The motor means is in a bell holding trapped air so that the water cannot reach the motor means. In one such embodiment the motor means is a single D.C. motor and in another embodiment it consists of a D.C. motor coupled by a one-way clutch to an A.C. motor which in turn is connected to the pump impeller. In each of these two embodiments, the water level sensor includes a tube having an open end in the bell to sample the air pressure in the bell and an end externally of the sump connected to a pressure actuated switch which turns on the motor means at a particular air pressure above ambient. Also within the bell is a float operated switch serving as a back-up to the air actuated switch. Using two motors, as mentioned above, the A.C. motor is turned on by an air pressure actuator at a lower air pressure above ambient than is the D.C. motor.

In another embodiment the case is cylindrical and elongated in the direction of its axis. The lower end of the case extends into the sump while the upper end stands above the sump. On the upper end are two motors, two pumps and the related controls. The intake lines for the pump extend down within the case into the sump, as do air pressure sampling tubes. One motor is turned on by a pressure actuated switch at a relatively low pressure above ambient while the other motor is turned on by a pressure actuated switch at a comparatively higher pressure over ambient.

3 Claims, 5 Drawing Figures

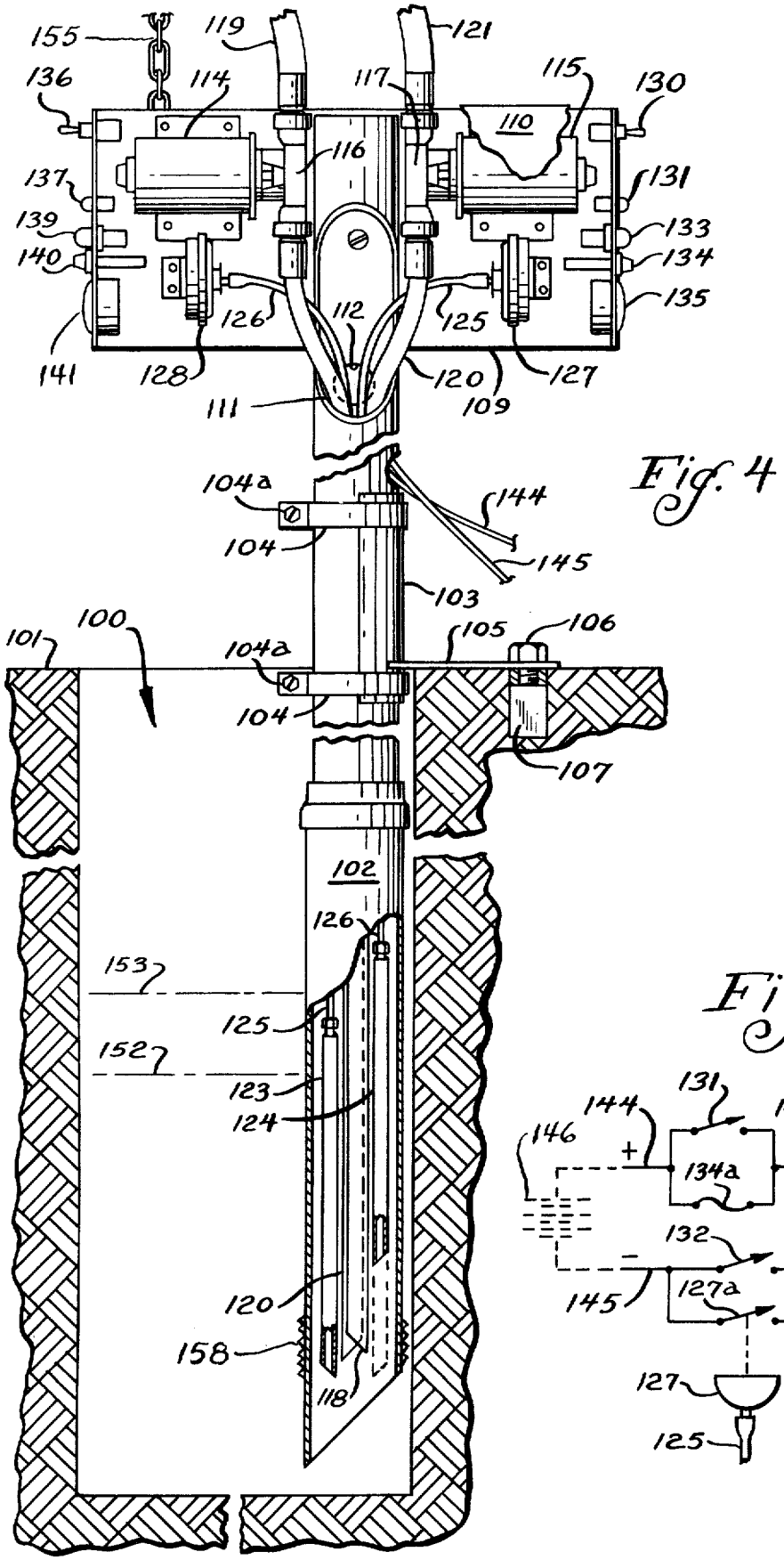
Fig. 4
Fig. 5
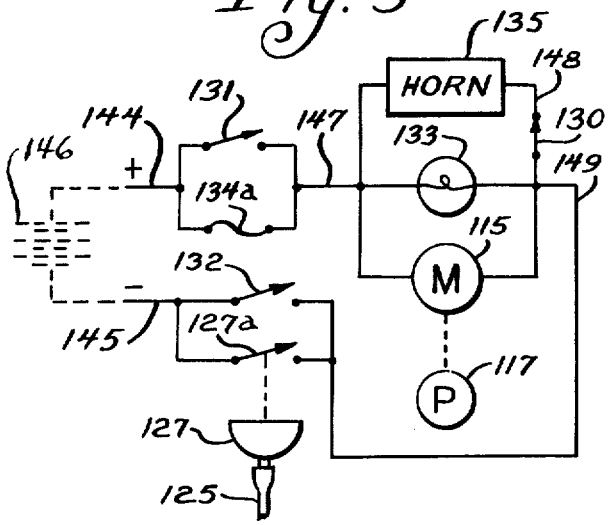

ENCLOSED SUMP PUMP

RELATED APPLICATION

This application is a continuation-in-part of my pending application Ser. No. 460,423, filed Apr. 12, 1974, now U.S. Pat. No. 3,941,507 the disclosure of which is incorporated herein by reference.

BACKGROUND AND SUMMARY OF THE INVENTION

In the main, sump pumps employed in the basements of homes, commercial buildings, etc., operate rather infrequently. However, it is extremely important that, when a substantial amount of water commences to accumulate in the sump (as for example during a storm), the pump will go into action to do its job of removing that water. Serious monetary, etc., losses can occur if the water is not removed and, of course, this is the purpose of installing the sump pump. To the end of ensuring reliable pump operation, various precautions are taken such as the use of a back-up battery operated pump, controls which will warn of malfunctions in the main pump or the back-up pump, etc. Such precautions are discussed in greater detail in the above identified application.

The present invention is primarily directed to improvements in the organization and structure of the mechanical components that are used in the sump per se to the end of achieving an apparatus which is more reliable, less likely to be subject to mechanical damage or breakdown, and can more easily be inspected for the possible existence of malfunction.

Another object of the invention is to provide a sump pump apparatus which is comparatively easy to install, even when the installation is performed by relatively inexperienced labor, as for example, by the home do-it-yourselfer.

Further objects and advantages will become apparent from the following description and the attached drawings.

DESCRIPTION OF THE DRAWINGS

FIG. 4 is a vertical section through a sump and illustrating another form of pump apparatus incorporating my invention, with portions broken away; and FIG. 5 is a schematic drawing illustrating the electrical control circuit for one of the pumps of the embodiment of FIG. 4.

DESCRIPTION OF SPECIFIC EMBODIMENTS

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

Figures 1, 2:
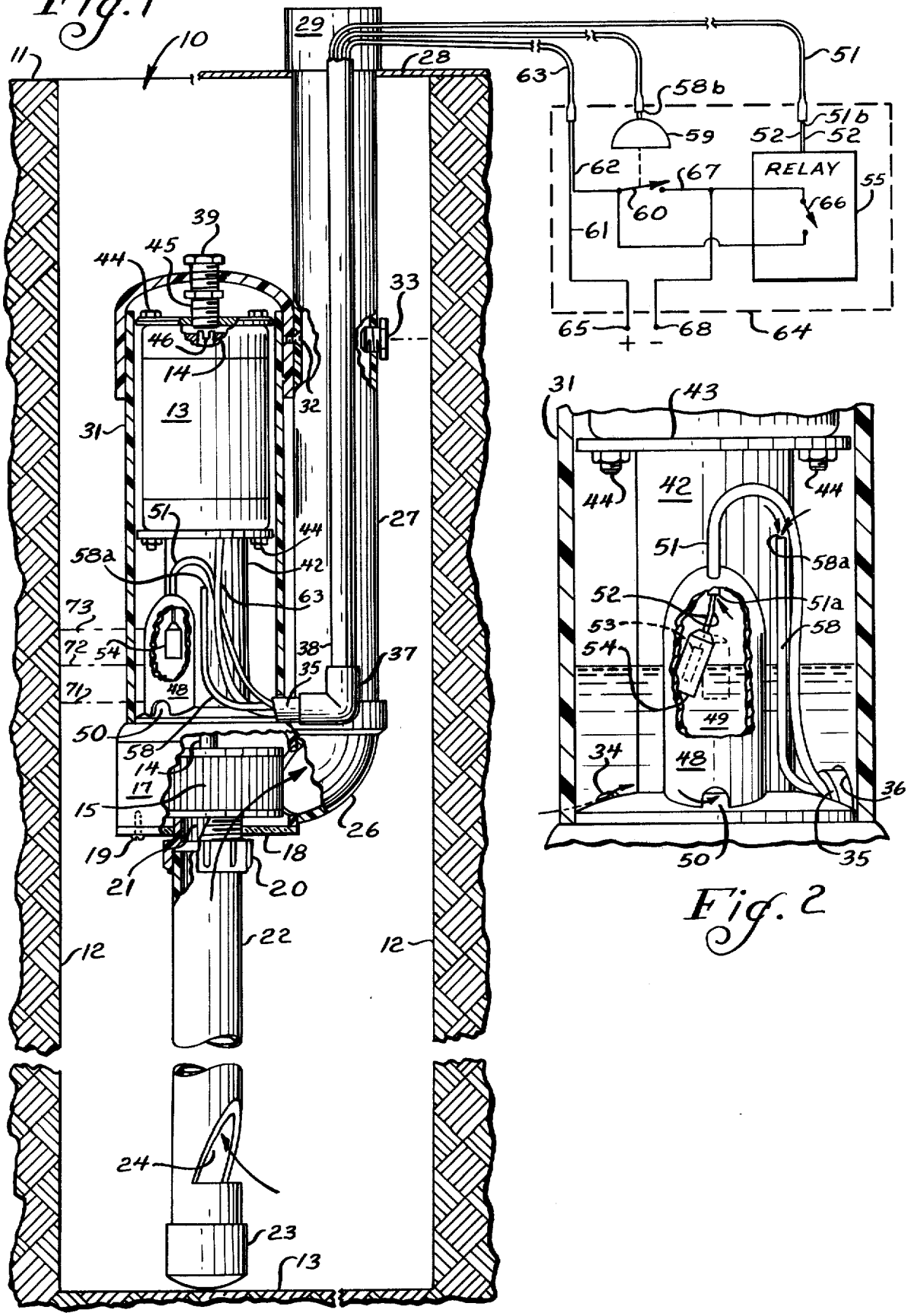
FIG. 1 is a vertical section through a sump showing an embodiment of the invention therein, with portions broken away.
FIG. 2 is an enlarged fragmentary section as viewed substantially corresonding to FIG. 1.

Referring to FIG. 1, there is a sump 10 which extends downwardly from a floor 11 and is used to accumulate liquids, e.g. water, etc., that may occasionally be present at or under the floor. The sump has sides 12 and a bottom 13. The pump includes an electric motor 13 having a shaft 14. A centrifugal or squirrel cage impeller 15 is secured to motor shaft 14.

The impeller 15 is mounted in an enclosure comprising an inverted cup component 17 and a cover plate 18. These are held together as by means of screws 19. The enclosure is formed of plastic, as for example polyvinyl chloride, as are the remaining body parts. The cover plate 18 is transparent. This permits the impeller 15 and the area thereabout (i.e. the interior of the enclosure) to be inspected without the necessity for disassembly of the component. A plastic pipe fitting 20 is threaded into cover plate 18 and serves as the liquid intake for the impeller enclosure. By rotating the fitting 20 with respect to cover plate 18 it can be moved toward and away from the impeller to thereby adjust the spacing of the intake opening 21 with respect to the impeller. A plastic pipe 22 frictionally engages fitting 20 and extends downwardly therefrom. At the bottom of pipe 22 a cap 23 is slipped onto the pipe and is in frictional engagement therewith. This cap closes the bottom of the pipe and provides a foot to support the apparatus from bottom 13 of the sump. Pipe 22 has an intake opening 24 adjacent the bottom end thereof. As will be apparent from the subsequent description regarding the operation, opening 24 is below the normal level of liquid in the sump.

Secured to enclosure component 17 is a plastic pipe elbow 26. Elbow 26 may be attached to component 17 by an adhesive or by means of fusion welding. A discharge pipe 27 is secured to elbow 26 (by adhesive, etc.) and extends upwardly therefrom. At the floor level this pipe is supported, as by means of a cover plate 28 extending across the sump. It has a coupling 29 which is used to attach additional lengths of pipe, not shown, leading to a suitable location for discharge of the liquid from the sump. Thus, the additional length of pipe might communicate with a storm sewer, lead-out of the building for discharge onto the lawn, etc.

Mounted above enclosure component 17 is a housing or case 31 in the form of a bell. In the illustrated embodiment this housing is made up of a cylinder with a cap permanently secured thereto, but it could be molded, etc., as a unit. The housing 31 is held in place by a screw 32. This screw extends through the wall of pipe 27 and is threaded into the plastic wall of the enclosure. To permit access to the screw 32 there is a removable plug 33 threaded into the opposite wall of the pipe 27. At the bottom of enclosure 31 are various openings, e.g. opening 34 in FIG. 2, to permit the liquid from the sump to flow in and out of the enclosure. A plastic pipe 35 also extends through an opening 36 in the bottom of the enclosure. Pipe 35 connects to an elbow 37 which in turn connects to a riser pipe 38. These are secured to elbow 26 and pipe 27 and serve as a protective conduit for the wiring, etc. Above the bottom openings 34, 36, the housing 31 is air tight. There is a plug 39 threaded into the top of the housing coaxial with shaft 14, but this is done in a fluid tight manner.

A plastic column 42 is mounted on the top of enclosure component 17. This column has a mounting plate 43 affixed to the upper end thereof. The motor bolts 44 hold the motor 13 to plate 43. Column 42 is coaxial with motor shaft 14 and the shaft extends down through the column. At the top the motor has a cap screw 45 coaxial with its shaft. One of the purposes of cap screw 45 and plug 39 is to apply pressure between the top of the motor and the top of enclosure 31. Cap screw 45 has an axial opening (not shown) therethrough. The motor shaft 14 has a screwdriver slot 46 in its upper end. Thus by removing plug 39 a screwdriver may be inserted through the opening in cap screw 45 and engaged with the screwdriver slot 46. This permits a serviceman to manually rotate the motor shaft 14. Such a test will easily allow the serviceman to determine whether the motor bearings are sticking, the impeller is obstructed, etc. Plug 39 also may be removed when it is desired to vent the enclosure 31 as a part of a servicing operation.

A wall 48 extends outwardly from column 42 and in conjunction with the column defines a chamber 49. Wall 48 has an opening 50 at its bottom to permit liquid to flow in and out of the chamber. A plastic tube 51 extends through the top of wall 48 in an air tight manner. A pair of wires 52 extend through tube 51. At one end, these wires connect to an electrical switch 53 in a float 54. At the other end they are in series with the solenoid, not shown, of a relay 55. The float 54 hangs from wires 52. The wires are sufficiently flexible so that the float can readily change position in response to variations in the liquid level in chamber 49. When the chamber is empty float 54 hangs vertically as shown in dashed lines in FIG. 2, and at that time the switch 53 is open. When water rises in chamber 49 the float will change its position, such as is shown in full lines in FIG. 2, and switch 53 will close. The ends 51*a* and 51*b* of tube 51 are open. Thus, the tube serves as a vent for chamber 49. Chamber 49 is fluid tight except for tube 51 and opening 50.

A second tube 58 has an end 58*a* within housing 31 and an end 58*b* which communicates with the interior of a fluid pressure actuator 59. When the air pressure in actuator 59 is a given amount above the ambient pressure, the actuator closes a normally open switch 60. Wires 61 and 62 are encased in a sheath 63. Within housing 31, the wires connect to motor 13. Within the external control box 64 wire 61 connects to battery terminal 65. Wire 62 connects to one side of switch 60 and to one side of relay switch 66. A wire 67 connects to the other side of switch 60 to a side of swich 66 and to battery terminal 68.

As the water level in the sump rises significantly above the level indicated by line 71, it will rise somewhat within housing 31, but to a much lesser extent. This is due to the fact that air is trapped within housing 31, preventing a corresponding rise of water within the housing. However, as the water level increases in the sump, the pressure of that trapped air correspondingly increases above ambient. The pressure of the trapped air is communicated through tube 58 to the actuator 59. Actuator 59 is set so that when the water level in the sump rises, say approximately to that indicated by line 72, actuator 59 will close switch 60. The effect of closing switch 60 is to energize motor 13 from the battery, e.g. a storage battery (not shown) connected to terminals 65 and 68. The energizing of the motor causes impeller 15 to rotate so that liquid from the sump is drawn in through opening 24 and discharged out through pipe 27. Even though the air pressure in housing 31 decreases with a drop in the water level in the sump 10, it is not until the water level approaches about that indicated by line 71 before switch 60 opens to deenergize the motor.

End 58*a* of tube 58 at all times remains above the level of the water within housing 31. By the same token, motor 13 is always above the water level in the housing. Thus the motor need not be of the submersible type, nor is there any necessity for shaft seals and the like to exclude the water from the motor bearings. There is no necessity for a seal about shaft 14 where that shaft enters the top of enclosure component 17.

As the liquid enters enclosure 31 through opening 34, it also flows through opening 50 into chamber 49. Since chamber 49 is vented through tube 51, the water is free to rise in that chamber corresponding to the level in the sump. When the water level in the sump reaches approximately that indicated by line 73, the float 54 changes position sufficiently so as to close switch 53. The closing of switch 53 actuates relay 55 to close switch 66. Thus if actuator 59 fails to close switch 60 upon the water level reaching line 72 (such as, for example, by reason of a break in tube 58), switch 66 will close when water level 73 is reached. The closing of switch 66 then serves to energize motor 13 and the pump is operated to remove liquid from the sump.

The controls in control box 64 of FIG. 1 are simplified and presented solely for the purpose of describing the operation of the pump structure. In actual practice, these controls would be much more sophisticated and could, for example, take the form illustrated and described in my patent application previously identified herein. Thus, for example, the actuator 59 of FIG. 1 hereof would correspond to the actuator 21 of that prior patent application and switch 53 hereof would correspond to switch 28 of the prior application.

With reference to the embodiment of FIG. 3, to the extent that the components illustrated in FIG. 3 correspond to those described in connection with FIGS. 1 and 2, they have been given the same number in FIG. 3 with a prime following the number. The principal difference between the two embodiments is that there are two motors to operate impeller 15′ in the FIG. 3 embodiment. Thus, there is a direct current motor 13′ and an alternating current motor 75. The shaft 14′ of motor 13′ is connected to a one-way clutch 76. The shaft 77 of motor 75 connects both to clutch 76 and to impeller 15′. When motor 75 is running and motor 13′ deenergized, clutch 76 slips or is free so that shaft 14′ stands still. However, when motor 13′ is running and motor 75 deenergized, clutch 76 engages so that shaft 14′ drives shaft 77. The housing or case 31′ is, of course, elongated sufficiently to accommodate the second motor and clutch.

A second tube 80 extends through conduit 38′. This tube has an open end 80*a* within the housing 31′ and an end 80*b* connected to a fluid pressure actuator 81. Actuator 81 controls a normally open switch 82. Three wires 83–85 extending through a sheath 86 connect to motor 75. In the control box 64′ wire 83 connects to an A.C. power terminal 87. Wire 85 connects to one side of switch 82. Wire 84 is a ground for safety purposes. A wire 88 connects from switch 82 to A.C. terminal 89.

Actuator 81 is set so that when the air pressure within housing 31′ corresponds to a water level in the sump as indicated by line 92, the switch 82 will be closed thus energizing A.C. motor 75. This operates impeller 15′ to pump water out of the sump 10′. When the water level has dropped approximately to that indicated by line 93, actuator 81 opens switch 82 to shut off motor 75.

Should motor 75 fail to operate (as for example, by reason of an electrical power failure in a storm) and the water level increases to approximately that indicated by line 95, actuator 59' closes switch 60'. Thus D.C. motor 13' is energized from a battery connected to terminals 65' and 68'. The rotation of shaft 14' causes clutch 76 to engage so that motor 13' now drives impeller 15' to pump water out of the sump. Actuator 59' opens switch 60' after the water level in the sump has dropped substantially, e.g. approximately to line 93'. A back-up float switch such as 54 could be used in the FIG. 3 embodiment, but normally is not necessary since switch 60' backs up switch 82.

As was previously described in connection with the embodiment of FIG. 1, the air trapped within housing 31' prevents the liquid which enters that housing at the bottom from rising very far in the housing. This protects the motors 13' and 75. That water will not overflow the tops 58*a'* and 80*a* of the tubes. While a single tube communicating both with actuator 59' and actuator 81 and extending into the interior of the housing could be used, I prefer to use two tubes. Thus, were there a break in one of the tubes, which break allowed air pressure in the tube to be lost, this would not disable both actuators, but would only disable the actuator to which the broken tube communicated. Water within housing 31' overflowing the top of a tube would be undesirable, but it would not prevent that tube from communicating air pressure to the respective actuator and the actuator would still respond to the air pressure within the housing 31'. Thus, that actuator would energize the respective motor even though water had gotten into the tube.

Figure 3:
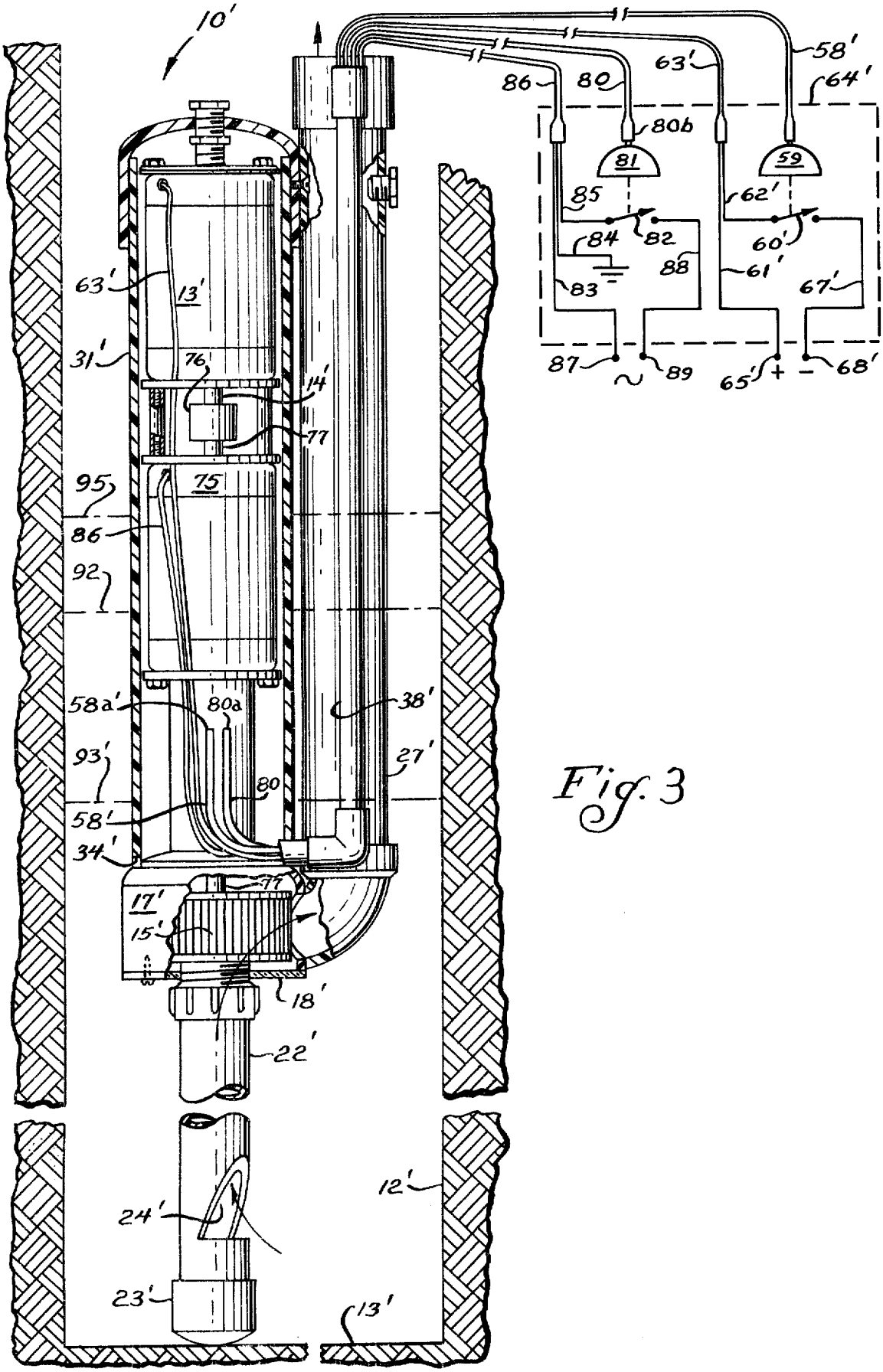
FIG. 3 is a view similar to FIG. 1 but showing an embodiment which incorporates an A.C. motor for normal sump pump operation and a supplemental D.C. motor to back up the A.C. motor, as for example in the case of power failure.

In the embodiment of FIG. 3, motor 75 was described as an A.C. motor. It will be apparent to those skilled in the art that it could be a D.C. motor if desired. Of course, in that event, an appropriate power supply would be connected to terminals 87 and 89. Similarly, an A.C. motor could be substituted for the D.C. motor 13 of the embodiment of FIG. 1. If desired, an additional motor could be added above the motor 13' in FIG. 3.

In FIG. 4 there is a sump 100 which extends down from a floor 101. A conduit in the form of a tube 102 extends into the sump and upwardly at least several feet above the floor 101. A saddle 103 is secured to conduit 102 by a pair of clamps 104 (such as large hose clamps). Saddle 103 has a projection 105 which rests on the floor and is held in place as by means of screws 106 inserted into concrete anchors 107.

Secured to the top of conduit 102 is a housing or case 109 having a removable cover 110. Adjacent its top the conduit 102 has an oblong opening 111. The back side of the conduit has a small opening 112 therein.

Two motors 114 and 115 each drive a respective pump 116 and 117. At its intake, pump 116 has a hose fitting to which is connected an intake hose 118. A hose fitting on the discharge side of pump 116 receives a discharge hose 119. Similarly, pump 117 has a intake hose 120 and a discharge hose 121 connected thereto. The two intake hoses 118 and 120 extend down nearly to the bottom of the conduit 102. Also adjacent the bottom of the conduit 102 are a pair of air scoops or bells 123 and 124. These air scoops are open at their bottom end and have tubes 125 and 126, respectively, secured to their upper ends. Tube 125 communicates with an air pressure actuator 127 and tube 126 connects to a corresponding air pressure actuator 128. These connections are formed merely by the tube being slipped onto a small pipe on the actuator. Thus they can be easily disengaged and replaced merely by movement of the tube off and on the pipe.

At the end of the housing 109 adjacent motor 115 are a toggle switch 130, two push-button switches 131 and 132 (132 is behind 131 in FIG. 4), a signal light 133, a fuse holder 134 and a horn 135. Similarly, the opposite end of the housing has a toggle switch 136, two push-button switches 137 and 138 (138 being concealed in FIG. 4), a signal light 139, a fuse holder 140, and a horn 141.

The control circuit for the motor 115 is illustrated in FIG. 5. The control circuit for motor 114 is not illustrated, but it is identical to FIG. 5. A pair of wires 144, 145 are used to connect the unit to a battery 146 and can be considered to be electric power terminals. Wire 144 connects to test switch 131 and to fuse 134*a*. Fuse 134*a* is mounted in fuse holder 134. A wire 147 connects to switch 131, fuse 134*a*, horn 135, signal light 133 and motor 115. A wire 148 connects horn 135 to normally closed toggle switch 130. A wire 149 connects toggle switch 130, light 133, and motor 115 to test switch 132 and switch 127*a* which is a part of the pressure actuator 127. Wire 145 connects to switches 132 and 127*a*.

The two pressure actuators 127 and 128 are used to actuate their respective switches at two different water levels in the sump. This is done by having one air scoop higher than the other as illustrated in FIG. 4. Which is higher is unimportant, but for the sake of illustration air scoop 124 is higher so that air pressure builds up in air scoop 123, before air pressure builds up in air scoop 124. Thus actuator 127 operates its switch 127*a* before actuator 128 operates its switch. As the water level rises in sump 100 and covers the open bottom ends of air scoops 123 and 124, air is trapped therein. With further increase in the water level in the sump, there is a corresponding increase in the pressure of the air trapped in the scoop. When the water level rises, as for example, to the level indicated by line 152, the air pressure in air scoop 123 (applied through tube 125 to actuator 127) is sufficient to cause the actuator to close switch 127*a*. This completes a circuit through motor 115 causing the motor to operate pump 117 and commence pumping the liquid out of the sump. At the same time, signal light 133 is illuminated and horn 135 also is energized. If it is desired to silence the horn, switch 130 may be opened. Some users of this device will not want to have the horn sound when the first pump starts operating, but will only want a horn alarm when the second pump commences operating. If that is desired by the user, then switch 130 would be left open at all times.

Assuming that pump 117 was not removing liquid from the sump as fast as the liquid was entering the sump, then the water level would continue to increase above that shown by line 152. This also could occur if pump 117 failed to operate properly. Upon the water level reaching a predetermined higher elevation, such as that illustrated by line 153, the air pressure in air scoop 124 would be sufficient to operate actuator 128. Thereupon, the electrical switch (not shown, but corresponding to 127*a*) operated by actuator 128 would close to energize motor 114. Now, two pumps would be running (assuming that pump 117 had not failed) to take care of the increased accumulation of water in sump 100. After the water level in the sump was lowered to adjacent, but above, the bottom opening in air scoop 124, actuator 128 would shut off motor 114. When the water level dropped about to the bottom of air scoop 123, actuator 127 would open switch 127*a* to shut off motor 115. So that floating debris will not enter the bottom opening in conduit 102, it is important that the bottom opening remain covered by liquid at all times.

The push-buttons 131, 132, 137, 138 are used to check the operation of the device and to look for component failures. For example, if it is desired to see whether the pump is in operating condition, switch 132 may be manually closed. This applies electrical power to horn 135, light 133 and motor 115. If each does not operate, a malfunction is indicated. If one operates but others do not, those others may be further inspected for trouble. If all three fail to operate, the fuse 134*a* is immediately suspect. To check this, switch 131 is closed while switch 132 is also closed. Of course, if all three, i.e. 115, 133 and 135, then operate, fuse 134*a* should be removed and additionally checked. It may be burned out.

Another operational check that a home owner can easily make is to observe hoses 118 and 120 while the respective pumps are operating. For this purpose, hoses 118 and 120 are clear plastic. Even with cover 110 in place, these hoses are clearly visible through opening 111. With one of the pumps running, the home owner should easily be able to see the water flowing upwardly through the respective hose. In some instances, it may be desirable to shine a light into opening 112 while such visual inspection is being made. If the water is not flowing rapidly and smoothly upwardly through the hose being inspected, the conduit 102 should be removed from the sump and the bottom of the hose inspected for clogging, etc.

Since the air scoops 123, 124 are set to operate the actuators 127, 128 at different water levels in the sump, it will be apparent that one motor and pump will always turn on. first. The other one will only turn on if the demand (water level in the sump) increases. This means that one motor and pump will tend to accumulate wear at a substantially greater rate than the other. To distribute the wear between the two units, the home owner should periodically reverse the sequence of operation. This may be done by changing the elevations of air scoops 123 and 124. That is, air scoop 124 can be lowered to the position indicated by dashed lines and air scoop 123 is raised by a corresponding amount. This will reverse the application of air pressure to the two actuators, i.e., actuator 128 will be operated first and actuator 127 will only be operated thereafter if the water level increases. The scoops and their respective tubes are supported by frictional engagement with the body, principally conduit 102. Their elevation may be changed by pulling up or down on the respective scoop and tube. An alternative procedure would be to remove tubes 125 and 126 from their respective actuators 127 and 128 and replace each on the other actuator, e.g. tube 125 on actuator 128.

The unit is particularly adapted to be installed by a do-it-yourselfer, e.g. home owner. There is a single unit which he purchases. He mounts bracket 105 at the side of the sump 100. Thereafter, by loosening screws 104*a* of clamps 104, the level of conduit 102 may be adjusted so that the bottom of the conduit is adjacent the bottom of the sump. Screws 104*a* are then retightened. Wires 144 and 145 are connected to a storage battery. Hoses 119 and 121 are connected to the pumps and lead to a remote location at which the liquid from the sump can be safely discharged. It is desirable that the battery 146 be kept fully charged. This may be done, for example, through the use of a conventional battery charger used for charging automobile batteries. Through the use of direct current motors and a battery, the apparatus is not dependent upon household current for its operation. That is, during a storm when there is a greater likelihood of water accumulating, the two pumps remain operational.

Since all of the components that must be inserted into the well (e.g. an intake and water level sensors) are encased in conduit 102, there is little likelihood of their being damaged either during installation or otherwise. Furthermore, the conduit protects them from floating debris.

As an alternative to mounting the FIG. 4 unit on the floor (by saddle 103, clamps 104, projection 105 and screws 106), the case 109 may be hung by chains 155 or the like from an overhead support such as a floor joist above the basement. This has an advantage of producing some noise when one or both of the pumps are running. Thus should a pump be running but the respective horn fail to sound (as for example, because switch 130 was left open), the noise of the running pump would alert the home owner to the fact that water had risen in the sump. The floor joist to which the chain, etc., was attached, along with the floor supported thereon would serve as a sounding board vibrated by the movement of the running pump.

I claim:

1. In a submersible sump pump apparatus comprising electric motor means, a vertically positioned shaft rotated by said motor means, an impeller secured to the lower end of the shaft, an enclosure about the impeller through which liquid is pumped from the sump,.and control means including a liquid level sensor device for controlling the starting and stopping of said motor means in response to the level of liquid in said sump, the improvement comprising:

a housing having an upper and a lower end, said housing having an opening therethrough for the entry of said liquid, said housing being fluid tight above said opening whereby air will be trapped in the housing and said liquid will not rise significantly above a given level in the housing no matter how high the liquid rises in the sump outside the housing;

said motor means being positioned in said housing above said given level whereby said liquid cannot reach said motor means thereby eliminating the necessity of a seal about the shaft and other measures to protect the motor means from the liquid;

an enclosed chamber in said housing, said chamber having an opening below said given level for the entry of liquid into said chamber, and means communicating with an upper part of the chamber for venting said chamber exteriorly of the housing whereby the chamber will fill with liquid to the extent that the liquid in the sump rises above said opening therein, said sensor device comprising a float switch positioned in said chamber to be effective when the liquid reaches an effective level in the chamber

2. In an apparatus as set forth in claim 1, wherein said means for venting said chamber comprises a tube communicating with said chamber and extending outside said housing and above said housing.

3. In an apparatus as set forth in claim 2, wherein said control means includes wires connected to said float switch, said wires extending through said tube, said float switch being suspended from said wires, said wires being sufficiently flexible to permit said float switch to move in response to changes in liquid level in the chamber.

* * * * *